US011643891B2

(12) United States Patent
Brana et al.

(10) Patent No.: US 11,643,891 B2
(45) Date of Patent: May 9, 2023

(54) DRILLING SYSTEM AND METHOD USING CALIBRATED PRESSURE LOSSES

(71) Applicant: Weatherford Technology Holdings, LLC, Houston, TX (US)

(72) Inventors: Jose D. Brana, Cypress, TX (US); Andrew V. Ilin, Sugar Land, TX (US); Sayamik N. Ameen, Houston, TX (US); Thomas H. Koithan, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 568 days.

(21) Appl. No.: 16/433,837

(22) Filed: Jun. 6, 2019

(65) Prior Publication Data

US 2020/0386066 A1 Dec. 10, 2020

(51) Int. Cl.

| | |
|---|---|
| ***E21B 21/08*** | (2006.01) |
| ***E21B 21/10*** | (2006.01) |
| ***E21B 44/00*** | (2006.01) |
| ***E21B 47/06*** | (2012.01) |
| ***E21B 21/06*** | (2006.01) |
| ***E21B 41/00*** | (2006.01) |

(52) U.S. Cl.

CPC ..... *E21B 21/08* (2013.01); *E21B 21/062* (2013.01); *E21B 21/106* (2013.01); *E21B 41/0092* (2013.01); *E21B 44/00* (2013.01); *E21B 47/06* (2013.01); *E21B 2200/20* (2020.05)

(58) Field of Classification Search

CPC ..... E21B 21/08; E21B 21/106; E21B 44/00; E21B 47/06; E21B 2200/20

See application file for complete search history.

(56) References Cited

U.S. PATENT DOCUMENTS

| | | | | |
|---|---|---|---|---|
| 7,836,973 | B2 * | 11/2010 | Belcher | E21B 21/08 175/25 |
| 10,184,305 | B2 * | 1/2019 | Lovorn | E21B 49/003 |
| 2004/0154832 | A1 | 8/2004 | Koithan | |

(Continued)

FOREIGN PATENT DOCUMENTS

EP 1898044 A2 3/2008

OTHER PUBLICATIONS

Oseme, U., et al. (2016) Bottom Hole Pressure Management in a Highly Permeable and Narrow Margin MPD Operation, SPE-AFRC-2571990-MS, In Proc. AAPG/SPE Africa Energy and Technology Conference, Nairobi City, Kenya, Dec. 5-7, 2016.

Rostami, S. A., et al. (2015) Dynamic Calibration of the Empirical Pore Pressure Estimation Methods Using MPD Data, OTC-25953-MS, In: Proc. Offshore Technology Conference, May 4-7, Houston, Texas, USA.

(Continued)

*Primary Examiner* — Matthew R Buck

(74) *Attorney, Agent, or Firm* — Cabello Hall Zinda, PLLC

(57) ABSTRACT

Control of a drilling system drilling a wellbore is improved using a hydraulic model corrected for pressure losses. A surface backpressure of the outlet and a standpipe pressure of the inlet are measured with sensors in the system. An estimate of the standpipe pressure is calculated based integrating from the measured surface backpressure back to the inlet in the hydraulics model. The pressure loss increment in the hydraulics model is calculated based on a difference between the measured and estimated standpipe pressures. Meanwhile, a parameter in the drilling system is monitored during drilling so the parameter can be adjusted at least partially based on the hydraulics model corrected for the pressure loss.

22 Claims, 4 Drawing Sheets

(56) References Cited

U.S. PATENT DOCUMENTS

| | | | | |
|---|---|---|---|---|
| 2005/0161260 | A1 | 7/2005 | Koithan et al. | |
| 2012/0292109 | A1* | 11/2012 | Lovorn | E21B 21/08 175/25 |
| 2013/0047696 | A1* | 2/2013 | Rasmus | E21B 49/005 73/1.67 |
| 2013/0013394 | A1 | 5/2013 | Lovorn | |
| 2013/0133948 | A1* | 5/2013 | Lovorn | E21B 21/08 175/24 |
| 2014/0202767 | A1 | 7/2014 | Feasey | |
| 2016/0102511 | A1 | 4/2016 | Brana et al. | |
| 2016/0245027 | A1 | 8/2016 | Gumus et al. | |
| 2018/0135365 | A1* | 5/2018 | Knudsen | E21B 21/106 |

OTHER PUBLICATIONS

Rostami, S. A., et al. (2016) New Generation of MPD Drilling Software—From Quantifying to Control, SPE-181694-MS, In: Proc. SPE Annual Technical Conference and Exhibition, Sep. 26-28, Dubai, UAE.

Salas-Bringas, C., et al. (2006) A calibration method for a new type of rheometer, Annual Transactions of the Nordic Rheology Society, 14.

Int'l Search Report received in copending PCT Application No. PCT/US2020/025804 dated Jul. 15, 2020, 12 pages.

Maurer W C, et al., "Development and Testing of Underbalanced Drilling Products", Internet Citation, Jul. 1, 2001, XP002361847, retrieved from the internet URL: http://www.osti.gov/servlets/purl/820613-qHnNEi/native/.

* cited by examiner

DRILLING SYSTEM AND METHOD USING CALIBRATED PRESSURE LOSSES

BACKGROUND OF THE DISCLOSURE

The flow of formation fluids into a wellbore during drilling operations, when the annular pressure (AP) is below the pore pressure (PP), is called an influx or "kick." By contrast, when the annular pressure is above the fracture pressure (FP), a fluid loss to the formation can occur. Hydrostatic pressure is the first conventional barrier for controlling the well from influxes and fluid losses. Rig blow out preventers (BOP) are a second barrier for influxes. Losses can be handled using lost circulation material (LCM) or by performing other procedures.

Even using available methods, both influxes and fluid losses can occur during drilling operations. Either event can have several detrimental effects. If a kick cannot be detected and controlled fast enough, it can escalate into uncontrolled flow of formation fluids to the surface, which is called a "blow-out," resulting in operational delays (non-productive time) or even more severe consequences to the safety of personnel or loss of the well.

For these reasons, accurate monitoring for downhole pressure changes is critical during drilling operations to maintain proper pressure balance in the well. Warning signs that are conventionally looked for when detecting sudden downhole condition changes are not always clear (e.g., change in the rate of penetration (ROP) and standpipe pressure), or the signs may arrive late (e.g., change in cutting size, Chloride level, etc.) after the changes has started. Sometimes, the frequency at which data is collected may be too slow to detect a kick or influx early enough. Moreover, measurements of return flow (i.e., flow-out) of the well may be subject to uncertainties due to heave effects, mud transfers, and gas inside the mud.

So far, flow deviation detection has been achieved by continuously monitoring the return flow from the wellbore (i.e., flow-out) in a closed-loop circulation system and comparing the flow-out to the flow-in. Several controlled pressure drilling techniques have been used to drill wellbores with such closed-loop drilling systems. In general, the controlled pressure drilling techniques include managed pressure drilling (MPD), underbalanced drilling (UBD), and air drilling operations.

In MPD, the drilling system uses a closed and pressurizeable mud-return system, a rotating control device (RCD), and a choke manifold to control the wellbore pressure during drilling. The various MPD techniques used in the industry allow operators to drill successfully in conditions where conventional technology simply will not work by allowing operators to manage the pressure in a controlled manner during drilling.

As the bit drills through a formation, for example, pores become exposed and opened. As a result, formation fluids (i.e., gas) from an influx or kick zone can mix with the drilling mud. The drilling system then pumps this gas, drilling mud, and the formation cuttings back to the surface. As the gas rises in the annulus of the well, the gas may expand, and the density of the mud may decrease, meaning more gas from the formation may be able to enter the wellbore. If the pressure of the mud column is less than the formation pressure, then even more influx could enter the wellbore.

Conventionally, drilling operators use pressure-while-drilling (PWD) data, when available, to monitor the drilling and determine the bottom hole pressure (BHP). However, PWD data cannot be used when pump rates are low, and the PWD data has a low resolution and a slow data transfer rate. These setbacks can result in unsafe way of drilling and controlling a well.

Control of pressures during drilling operations may be based on a hydraulics model that calculates BHP and bottomhole temperature. Efficient control of the BHP during MPD operations requires a very precise hydraulics model, which might not always interoperate downhole condition. For example, the annular pressure profile being modeled may be different from the actual physical system. Although the hydraulic model accounts for numerous details related to the drill-pipe, drill bit and casing geometry, effect of temperature from formation, mud, effect of cuttings, it may be difficult to model the characteristics of open hole formations, fluid density, rheology, and other factors properly.

The subject matter of the present disclosure is directed to overcoming, or at least reducing the effects of, one or more of the problems set forth above.

SUMMARY OF THE DISCLOSURE

As disclosed herein, a method implemented by a computerized control is for a drilling system, which can have at least one pump for pumping drilling fluid at an inlet into a wellbore and can have at least one choke for choking the drilling fluid at an outlet from the wellbore.

The wellbore is drilled with the drilling system, and a hydraulic model is built of the drilling system drilling the wellbore. A measured value of surface backpressure $SBP_M$ is obtained of the outlet, and a measured value of standpipe pressure $SPP_M$ is obtained of the inlet.

An estimated value of standpipe pressure $SPP_E$ is determined of the inlet based on the hydraulics model and the measured surface back pressure $SBP_M$ value. Pressure loss in the hydraulics model is corrected based on a difference between the measured standpipe pressure $SPP_M$ and the estimated standpipe pressure $SPP_E$.

The input parameter in the drilling system is adjusted at least partially based on the hydraulics model corrected for the pressure loss calculation.

The inputs for the hydraulics model can include: a trajectory of the wellbore, a true vertical depth of the wellbore, an inclination of the wellbore, an azimuth of the wellbore, a geometric parameter of the drilling system, a geometry of an annulus of the wellbore, a geometry of a drillstring, a fluid property of the drilling fluid, a density of the drilling fluid, a rheology of the drilling fluid, a thermal property for the drilling fluid, a thermal property of the formation, a thermal property of the drillstring, a temperature of a formation in the wellbore, an empirical formula for local pressure loss from a component of the drilling system, operational data obtained during drilling, flow rate, rotation per minute rate (RPM), bit depth, and fluid input temperature.

To obtain the measured surface backpressure $SBP_M$ value of the outlet, the value of the surface back pressure SBP can be measured with a sensor located upstream of the at least one choke.

The sensor can be selected from the group consisting of a pressure transducer, a pressure gauge, a diaphragm based pressure transducer, and a strain gauge based pressure transducer, an analog device, and an electronic device.

To obtain the measured value of the standpipe pressure $SPP_M$ of the inlet, the value of the standpipe pressure SPP can be measured with a sensor disposed in communication with flow of the drilling fluid into the wellbore downstream of the at least one pump. As before, this sensor can be selected from the group consisting of a pressure transducer, a pressure gauge, a diaphragm based pressure transducer, and a strain gauge based pressure transducer, an analog device, and an electronic device.

To determine the estimated value of the standpipe pressure $SPP_E$ of the inlet based on the hydraulics model and the measured surface backpressure $SBP_M$ value, a pressure profile of the hydraulics model can be integrated from the measured surface backpressure $SBP_M$ of the outlet to the inlet.

To integrate the pressure profile of the hydraulics model from the measured surface backpressure $SBP_M$ of the outlet to the inlet, an estimated bottom hole pressure $BHP_E$ can be determined by integrating the pressure profile from the measured surface backpressure $SBP_M$ value down an annulus of the wellbore to a bottom hole assembly of a drillstring of the drilling system disposed in the wellbore. Then, the estimated standpipe pressure $SPP_E$ value can be determined by integrating the pressure profile from the estimated bottom hole pressure $BHP_E$ up the drillstring of the bit to the inlet from the at least one mud pump.

To determine the estimated value of the standpipe pressure $SPP_E$ of the inlet, the estimated standpipe pressure $SPP_E$ value can be calculated as a sum of the measured surface backpressure $SBP_M$ value, a U-tube pressure loss, and a friction pressure loss.

The U-tube pressure loss can comprise a difference in first hydrostatic pressure in an annulus of the wellbore and second hydrostatic pressure in a drillstring of the drilling system.

The friction pressure loss can comprise a value of distributed friction and a value of any local pressure loss from one or more components of the drilling system.

To correct the pressure loss in the hydraulics model based on the difference between the measured standpipe pressure $SPP_M$ value and the estimated standpipe $SPP_E$ valve, a friction factor of the pressure loss in the hydraulics model can be calibrated by iteratively incrementing the friction factor at least until the estimated standpipe pressure $SPP_E$ value matches the measured standpipe pressure $SPP_M$ value within a threshold.

The method can further comprise determining a factor of the pressure loss due to rotational friction in an annulus of the wellbore by refining rheology characteristics of the drilling fluid when a drillstring is not being rotated.

The method can further comprise: obtaining a measured value of pressure-while-drilling indicative of bottom hole pressure at a bottom hole assembly of the drillstring; determining an estimated value of bottom hole pressure $BHP_E$ at the bottom hole assembly based on the hydraulics model and the measured bottom hole pressure value; and correcting the pressure loss in the hydraulics model based on another difference between the measured bottom hole pressure $BHP_M$ and the estimated bottom hole pressure $BHP_E$.

To adjust the parameter in the drilling system, the at least one choke in communication with the drilling fluid from the wellbore can be adjusted. In adjusting the parameter, a flow rate or a pressure of flow of the drilling fluid out of the wellbore can be adjusted using the at least one choke. For example, the pressure can be adjusted on the surface to change downhole pressure.

Adjusting the parameter in the drilling system can involve adjusting at least one of: a flow rate of the drilling fluid out of the wellbore, a pressure of flow of the drilling fluid out of the wellbore using the at least one choke, a current surface backpressure SBP in the wellbore, a mass flow rate of the drilling fluid out of the wellbore, a pressure during make-up of a drillpipe connection, a pressure during a loss detected, or flow during a kick detected while drilling with the drilling system.

Obtaining the measured value of the parameter in the drilling system can comprise: determining outflow of the drilling fluid from the wellbore; determining inflow of the drilling fluid into the wellbore; and determining an imbalance between the outflow and the inflow as the measured parameter value.

To determine the outflow of the drilling fluid from the wellbore, the outflow can be measured with a flowmeter in communication with the outflow. To determine the inflow of the drilling fluid into the wellbore, the inflow can be measured with a flowmeter in communication with the inflow.

According to the present disclosure, a programmable storage device can have program instructions stored thereon for causing a programmable control device to perform a method of drilling a wellbore with drilling fluid using a drilling system as described above.

According to the present disclosure, a system is used for drilling a wellbore with drilling fluid. The system comprises at least one pump, at least on choke, storage, a first sensor, a second sensor, and a programmable control device. The at least one pump is disposed at an inlet of the system and is operable to pump the drilling fluid into the wellbore when drilling the wellbore with the drilling system. The at least one choke is disposed at an outlet of the system and is operable to adjust flow of the drilling fluid from the wellbore when drilling the wellbore with the drilling system.

The storage stores a hydraulic model of the drilling system drilling the wellbore. A first sensor is configured to measure a value of surface backpressure SBP upstream of the at least one choke, and a second sensor is configured to measure a value of standpipe pressure SPP downstream of the at least one pump.

The programmable control device is communicatively coupled to the storage, the first sensor, and the second sensor. The device is configured to perform the steps of the method described above.

The device is configured to obtain a measured value of surface backpressure $SBP_M$ from the first sensor and to obtain a measured value of standpipe pressure $SPP_M$ from the second sensor. An estimated value of standpipe pressure $SPP_E$ of the inlet is determined based on the hydraulics model and the measured surface backpressure $SBP_M$ value, and pressure loss is corrected in the hydraulics model based on a difference between the measured standpipe pressure $SPP_M$ and the estimated standpipe pressure $SPP_E$.

A measured value is obtained of a parameter in the drilling system. The parameter is then adjusted in the drilling system at least partially based on the hydraulics model corrected for the pressure loss.

The foregoing summary is not intended to summarize each potential embodiment or every aspect of the present disclosure.

DETAILED DESCRIPTION OF THE DISCLOSURE

Figure 1:
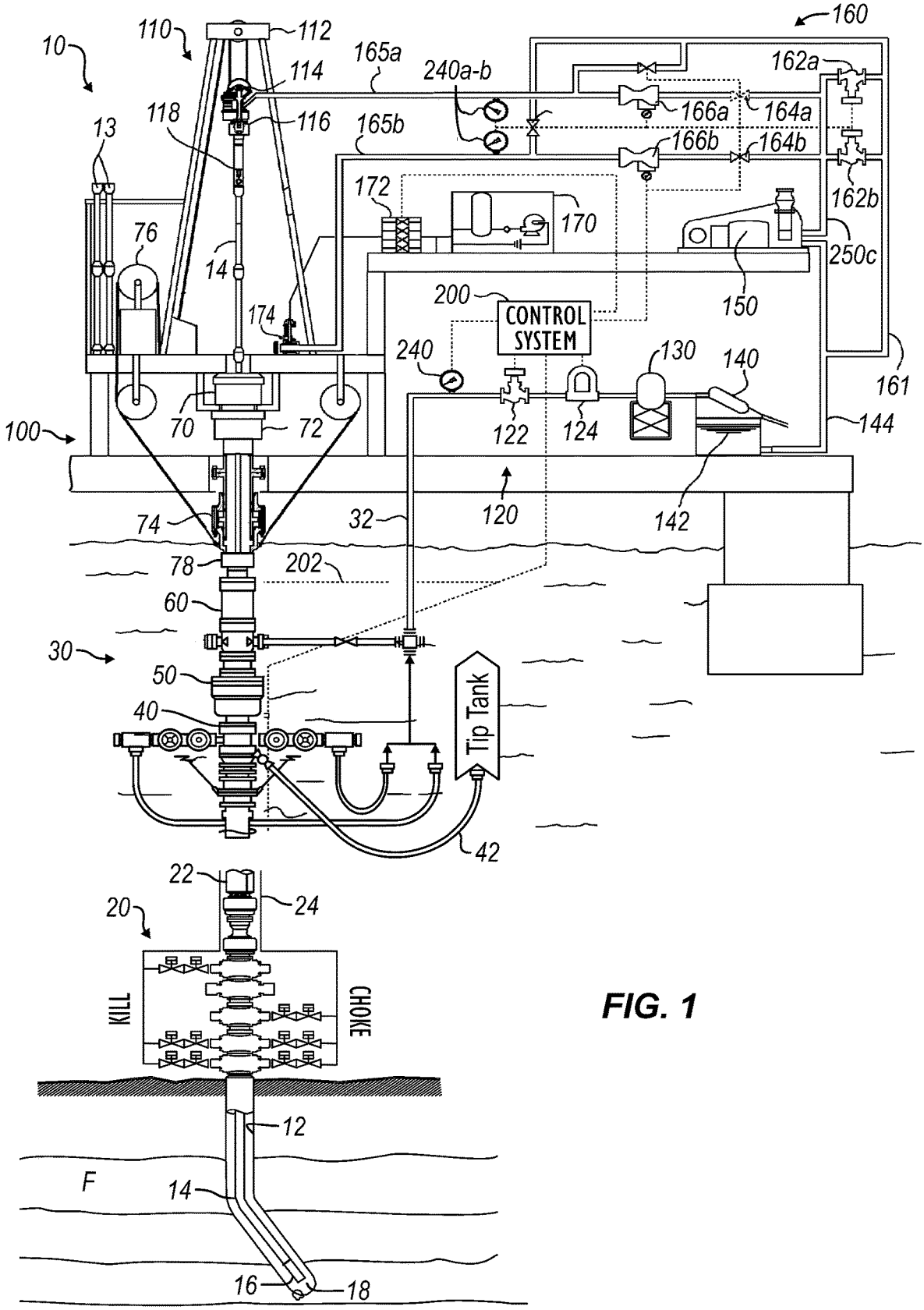
FIG. 1 illustrates a controlled pressure drilling system having a control system according to the present disclosure.

FIG. 1 shows a closed-loop drilling system 10 according to the present disclosure for controlled pressure drilling. As shown and discussed herein, this system 10 can be a MPD system and, more particularly, a Constant Bottom-hole Pressure (CBHP) form of MPD system. Although discussed in this context, the teachings of the present disclosure can apply equally to other types of controlled pressure drilling systems, such as other MPD systems (Pressurized Mud-Cap Drilling, Returns-Flow-Control Drilling, Dual Gradient Drilling, etc.) as well as to UBD systems, as will be appreciated by one skilled in the art having the benefit of the present disclosure.

The drilling system 10 may be a land-based system or an offshore system. As shown here, the drilling system 10 includes a mobile offshore drilling unit 100, such as a semi-submersible, having a drilling rig 110 and components for fluid handling.

The drilling rig 110 includes a derrick 112 having a traveling block supporting a top drive 116, which couples to a flow sub 118. A top of the drillstring 14 connects to the flow sub 118, such as by a threaded connection, or by a gripper (not shown), such as a torque head or spear. The top drive 116 is operable to rotate the drillstring 14 extending from the derrick 112 and includes an inlet 114 coupled to a Kelly hose to provide fluid communication between the Kelly hose and the flow sub 118 and drillstring 14 extending therefrom.

The drillstring 14 extending from the rig 110 includes a bottomhole assembly (BHA) 16 at the end of the connected joints of drillpipe. The BHA 16 can typically include a drill bit 18, drill collars, a drilling motor (not shown), a measurement while drilling, a logging while drilling sub, and the like for drilling a borehole 12.

The drilling system 10 further includes an upper marine riser package (UMRP) 30, a riser 22, auxiliary lines (boost, choke, etc.) 24, and other components. As is customary, the riser 22 extends from the rig 110 to a wellhead 20 located on the sea floor. The riser 22 typically connects to the wellhead 20 with a wellhead adapter, and the wellhead 20 typically has blow-out preventers (BOPS) and connects to the riser lines 24, such as booster line, choke line, kill line, and the like.

The riser package 30 include a diverter 70, a flex joint 72, a telescopic joint 74, a tensioner 76, a tensioner ring 78, and a rotating control device (RCD) 60. For example, the slip joint 74 includes an outer barrel connected to an upper end of the RCD 60 and includes an inner barrel connected to the flex joint 72. The outer barrel may also be connected to the tensioner 76 by the tensioner ring 78.

The RCD 60 can include any suitable pressure containment device that keeps the wellbore 12 in a closed-loop at all times while the wellbore 12 is being drilled. (As will be appreciated, the wellbore 12 includes the borehole in the formation F and includes the riser 22 which constitutes an extension of the borehole). In this way, the RCD 60 can contain and divert annular drilling returns via a flow line 62 to complete the circulating system to create the closed-loop of incompressible drilling fluid.

The RCD 60 can include any typical construction. For example, the RCD 60 may include a housing, a piston, a latch, and a rider. The housing may be tubular and have one or more sections connected together, such as by flanged connections. The rider may include a bearing assembly, a housing seal assembly, one or more strippers, and a catch sleeve. The rider may be selectively longitudinally and torsionally connected to the housing by engagement of the latch with the catch sleeve. The housing may have hydraulic ports in fluid communication with the piston and an interface of the RCD 60. The bearing assembly may support the strippers from the sleeve such that the strippers may rotate relative to the housing (and the sleeve). The bearing assembly may include one or more radial bearings, one or more thrust bearings, and a self-contained lubricant system. The bearing assembly may be disposed between the strippers and be housed in and connected to the catch sleeve, such as by a threaded connection and/or fasteners.

Each stripper in the RCD 60 may include a gland or retainer and a seal. Each stripper seal may be directional and oriented to seal against the drillstring 14 in response to higher pressure in the riser 22 than the UMRP 30. Each stripper seal may have a conical shape for fluid pressure to act against a respective tapered surface thereof, thereby generating sealing pressure against the drillstring 14. Each stripper seal may have an inner diameter slightly less than a pipe diameter of the drillstring 14 to form an interference fit therebetween. Each stripper seal may be flexible enough to accommodate and seal against threaded couplings of the drillstring 14 having a larger tool joint diameter. The drillstring 14 may be received through a bore of the rider so that the stripper seals may engage the drillstring 14. The stripper seals may provide a desired barrier in the riser 22 either when the drillstring 14 is stationary or rotating.

The RCD 60 may be submerged adjacent the waterline. The RCD interface may be in fluid communication with an auxiliary hydraulic power unit (HPU) (not shown) of a control system 200 via control lines 202. An active seal RCD may be used. Alternatively, the RCD 60 may be located above the waterline and/or along the UMRP 30 at any other location besides a lower end thereof. Alternatively, the RCD 60 may be assembled as part of the riser 22 at any location therealong.

The RCD 60 may be connected to other flow control devices, such as an annular seal device 50, a flow spool 40 having controllable valves, and the like, as used in MPD. The annular seal device 50 can be used to sealingly engage (i.e., seal against) the drillstring 14 or to fully close off the riser 22 when the drillstring 14 is removed so fluid flow up through the riser 22 can be prevented. Typically, the annular seal device 50 can use a sealing element that is closed radially inward by hydraulically actuated pistons. The control lines 202 from hydraulic components on the rig 100 can be used to deliver controls to the annular seal device 50.

The flow spool 40 can include a number of controllable valves (not shown) that connect to flow connections 42 to communicate the internal passage of the riser 22 with rig components on the rig 100. Flow lines 32 from the riser package 30 may be used to communicate flow, and the control lines 202 on the riser 22 may also be used to deliver controls to open and close the controllable valves.

In addition to the riser package 30, the drilling system 10 also includes a choke manifold 120, a mud gas separator 130, a shaker 140, mud tanks 142, mud pumps 150. In addition to these, the drilling system 10 includes flow equipment 160 to deliver flow to the drillstring 14 through the Kelly hose connected to a supply line 165*a* or through a clamp 174 connected to a bypass line 165*b* and couplable to the flow sub 118. The clamp 174 and flow sub 118 are part of a continuous flow system that allows flow to be maintained while pipe connections are being made.

One or more return lines 32 connects from the riser package 30 to the choke manifold 120. A return pressure sensor 240, return choke 122, and return flow meter 124 communicate with the flow from the return line 32. After the choke manifold 120, the flow eventually communicates with the mud gas separator 130 and the shaker 140.

A transfer line 144 connects an outlet of the mud tanks 142 to the mud pumps 150. A standpipe 152 connects from the mud pumps 150 to the drilling rig 110 to conduct drilling fluid from the mud pumps 150 to the Kelly hose and other flow connections. The standpipe 152 can include a pressure sensor 250*c* near the pumps 150 or elsewhere in the flow after the pumps 150.

Here, the standpipe 152 also includes flow equipment 160 connected between the mud pumps 150 and the rig 110 for directing drilling flow into the drillstring 14 via the Kelly hose or via the clamp 174. The flow equipment 160 includes a supply line 165*a* connected from the mud pumps 150 to the top drive inlet 114. A supply pressure sensor 250*a*, a supply flow meter 166*a*, and a supply shutoff valve 164*a* may be assembled as part of the supply line 165*a*.

Additionally, the flow equipment 160 includes a bypass line 165*b* connecting the standpipe 152 from the mud pump 150 to the clamp 174. An HPU 170 connects by hydraulic lines and manifold 172 to the clamp 174 to control its operation. For example, when the top drive 116 runs the drillstring 14 into the wellbore 12, the clamp 174 can engage the flow sub 118, and the pumped flow of the drilling fluid can be bypassed to the bypass line 165*b*. In this way, continuous flow into the drillstring 14 can be maintained while making up new stands 13 of pipe to the drillstring 14. A bypass pressure sensor 250*b*, bypass flowmeter 166*b*, and bypass shutoff valve 164*a* can be assembled as part of the bypass line 165*b*.

Finally, the flow equipment 160 can further include a drain line 161 connecting the transfer line 144 to the supply and bypass lines 165*a-b*. Drain prongs of the drain line 161 can have drain valves, pressure chokes 162*a-b*, and the like connected to an outlet of the mud pump 150.

The pressure sensor 240, 250*a-c* can use any suitable sensor for measuring pressure, such as a pressure transducer, a pressure gauge, a diaphragm based pressure transducer, a strain gauge based pressure transducer, an analog device, an electronic device, or the like.

Each choke 122, 162, etc. may include a hydraulic actuator operated by the control system 200 via an auxiliary HPU (not shown). The return choke 122 receiving flow returns diverted from riser package 30 is operated by the control system 200 to adjust backpressure in the riser 22 and the wellbore 12 for well control.

The flow choke 162*a* may be operated by the control system 200 to prevent a flow rate supplied to the flow sub 118 and the clamp 174 in bypass mode from exceeding a maximum allowable flow rate of the flow sub 118 and/or clamp 174. The pressure choke 162*b* may be operated by the control system 200 to protect against overpressure of the clamp 174 by the mud pumps 150. Each shutoff valve 164*a-b* and others may be automated and have a hydraulic actuator (not shown) operable by the control system 200 via the auxiliary HPU.

The control system 200 of the drilling system 10 integrates hardware, software, and applications across the drilling system 10 and is used for monitoring, measuring, and controlling parameters in the drilling system 10. In this contained environment of the closed-loop system 10, for example, minute wellbore influxes or losses are detectable at the surface, and the control system 200 can further analyze pressure and flow data to detect kicks, losses, and other events. In turn, at least some operations of the drilling system 10 can be automatically handled by the control system 200.

To monitor operations, the control system 200 uses data from a number of the sensors and devices in the system 10. In particular, the control system 200 uses the one or more sensors 240 uphole of the choke manifold 120 to measure pressure in the flow returns from the riser 22 and the wellbore 12. As the choke 122 in the manifold 120 is adjusted, the one or more sensors 240 measure the surface backpressure SBP applied to the riser 22 and the wellbore 12.

In addition, the control system 200 can use the one or more sensors 250*a-c* downstream of the mud pumps 150 to measure pressure in the standpipe 152 (i.e., the standpipe pressure SPP). One or more other sensors (i.e., stroke counters) can measure the speed of the mud pumps 150 for deriving the flow rate of drilling fluid into the drillstring 14. In this way, flow into the drillstring 14 may be determined from strokes-per-minute and/or standpipe pressure SPP. The flowmeters 166*a-b* after the pumps 150 can also be used to measure flow-in to the wellbore 12.

One or more sensors (not shown) can measure the volume of fluid in the mud tanks 142 and can measure the rate of flow into and out of mud tanks 142. In turn, because a change in mud tank level can indicate a change in drilling fluid volume, flow-out of the wellbore 12 may be determined from the volume entering the mud tanks 142.

Rather than relying on conventional pit level measurements, paddle movements, and the like, the system 10 can use mud logging equipment and flowmeters to improve the accuracy of detection. For example, the system 10 preferably uses the flowmeter 124, such as a Coriolis mass flowmeter, on the choke manifold 120 to capture fluid data—including mass and volume flow, mud weight (i.e., density), and temperature—from the returning annular fluids in real-time, at a sample rate of several times per second. Because the Coriolis flowmeter 124 gives a direct mass rate measurement, the flowmeter 124 can measure gas, liquid, or slurry. Other sensors can be used, such as ultrasonic Doppler flowmeters, SONAR flowmeters, magnetic flowmeter, rolling flowmeter, paddle meters, etc.

Each pressure sensor 240, 250*a-c* may be in data communication with the control system 200. The return pressure sensor 240 measures surface backpressure (SBP) exerted by the returns choke 122. The pressure sensor 250*c* and/or the supply pressure sensor 250*a* measures standpipe pressure ($SPP_M$) to the Kelly hose, whereas the pressure sensor 250*c* and/or the bypass pressure sensor 250*b* measures the standpipe pressure SPP to the clamp 174 during connection of a standpipe.

As noted above, the return flowmeter 124 may be a mass flow meter, such as a Coriolis flowmeter, and is in data communication with the control system 200. The return flowmeter 124 connected in the return line 62 downstream of the returns choke 122 measures a flow rate of the returns. Each of the supply and bypass flowmeters 164*a-b* may be a volumetric flowmeter, such as a Venturi flowmeter. The supply flowmeter 164*a* measures a flow rate of drilling fluid supplied by the mud pump 150 to the drill string 14 via the top drive 116. The bypass flowmeter 164*b* measures a flow rate of drilling fluid supplied by the mud pump 150 to the clamp 174. The control system 200 can receive a density measurement of the drilling fluid from a mud blender (not shown) or other source to determine a mass flow rate of the drilling fluid. Alternatively, the bypass and supply flowmeters 164*a-b* may each be mass flowmeters.

Additional sensors can measure mud gas, flow line temperature, mud density, and other parameters. For example, a flow sensor can measure a change in drilling fluid volume in the well. Also, a gas trap, such as an agitation gas trap, of the mud gas separator 130 can monitor hydrocarbons in the drilling mud at surface. To determine the gas content of drilling mud, for example, the gas trap of the separator 130 mechanically agitates mud flowing in a tank. The agitation releases entrained gases from the mud, and the released gases are drawn-off for analysis. The spent mud is simply returned to the tanks 142 to be reused in the drilling system 10.

A gas evaluation device can be used for evaluating fluids in the drilling mud, such as evaluating hydrocarbons (e.g., C1 to C10 or higher), non-hydrocarbon gases, carbon dioxide, nitrogen, aromatic hydrocarbons (e.g., benzene, toluene, ethyl benzene and xylene), or other gases or fluids of interest in drilling fluid. Accordingly, the device 126 can include a gas extraction device that uses a semi-permeable membrane to extract gas from the drilling mud for analysis.

A multi-phase flowmeter can be installed in the flow line to assist in determining the make-up of the fluid. As will be appreciated, the multi-phase flow meter can help model the flow in the drilling mud and provide quantitative results to refine the calculation of the gas concentration in the drilling mud.

With the overview of the drilling system 10 provided above, discussion turns to operation of the drilling system 10 in drilling a wellbore 12. During drilling operations, the mud pumps 150 pump drilling fluid from the transfer line 144 (or fluid tank connected thereto), through the standpipe 152 and the Kelly hose to the top drive 116. The drilling fluid may include a base liquid, such as oil, water, brine, or a water/oil emulsion. The base oil may be diesel, kerosene, naphtha, mineral oil, or synthetic oil. The drilling fluid may further include solids dissolved or suspended in the base liquid, such as organophilic clay, lignite, and/or asphalt, thereby forming a mud.

The drilling fluid at the inlet 114 flows into the drillstring 14 via the top drive 116 and flow sub 118. The drilling fluid flows down through the drillstring 14 and exits the drill bit 18 of the BHA 16, where the fluid circulates the cuttings away from the bit 18 and returns the cuttings up an annulus formed between the casing or wellbore 12 and the drillstring 14. The returns (drilling fluid plus cuttings) flowing through the annulus to the wellhead 20 then continue into the annulus of the riser 22 up to the RCD 60.

At the RCD 60, the system 10 uses the RCD 60 to keep the well closed to atmospheric conditions. The returns are diverted into the return line 32 and continue through the returns choke 122 and the flowmeter 124. Therefore, fluid leaving the wellbore 12 flows through the automated choke manifold 120, which measures return flow (e.g., flow-out) and density using the flowmeter 124 installed in line with the chokes 122. The returns then flow into the shale shaker 140, which remove the cuttings. As the drilling fluid and returns circulate, the drillstring 14 may be rotated by the top drive 116 and lowered by the traveling block, thereby extending the wellbore 12 into the lower formation F.

Throughout the drilling operation, the fluid data and other measurements noted herein are transmitted to the control system 200, which in turn operates drilling functions. In particular, the control system 200 operates the automated choke manifold 120 to manage pressure and flow during drilling. This can be achieved using an automated choke response in the closed and pressurized circulating system 10 made possible by the RCD 60.

To do this, the control system 200 controls the chokes 122 with an automated response by monitoring the flow-in and the flow-out of the well, and software algorithms in the control system 200 seek to maintain a mass flow balance. If a deviation from mass flow balance is identified, the control system 200 initiates an automated choke response that changes the well's annular pressure profile and thereby changes the wellbore's equivalent mud weight. This automated capability of the control system 200 allows the system 200 to perform dynamic well control or CBHP techniques.

Software components of the control system 200 then compare the flow rate in and flow rate out of the wellbore 12, the injection or standpipe pressure SPP (measured by the one or more sensors 250*a-c*), the surface backpressure SBP (measured by the one or more sensors 240 upstream from the drilling chokes 122), the position of the chokes 122, and the mud density, among other possible variables. Comparing these variables, the control system 200 then identifies minute downhole influxes and losses on a real-time basis to manage the annular pressure (AP) during drilling by apply adjustments to the surface backpressure (SBP) with the choke manifold 120.

By identifying the downhole influxes and losses during drilling, for example, the control system 200 monitors circulation to maintain balanced flow for CBHP under operating conditions and to detect kicks and lost circulation events that jeopardize that balance. The drilling fluid is continuously circulated through the system 10, choke manifold 120, and the Coriolis flowmeter 124. As will be appreciated, the flow values may fluctuate during normal operations due to noise, sensor errors, etc. so that the system 200 can be calibrated to accommodate such fluctuations. In any event, the system 200 measures the flow-in and flow-out of the well and detects variations. In general, if the flow-out is higher than the flow-in, then fluid is being gained in the system 10, indicating a kick. By contrast, if the flow-out is lower than the flow-in, then drilling fluid is being lost to the formation, indicating lost circulation.

To then control pressure, the control system 200 introduces pressure and flow changes to the incompressible circuit of fluid at the surface to change the annular pressure profile in the wellbore 12. In particular, using the choke manifold 120 to apply surface backpressure SBP within the closed loop, the control system 200 can produce a reciprocal change in BHP. In this way, the control system 200 uses real-time flow and pressure data and manipulates the annular backpressure to manage wellbore influxes and losses.

To do this, the control system 200 uses internal algorithms to identify what event is occurring downhole and can react automatically. For example, the control system 200 monitors for any deviations in values during drilling operations, and alerts the operators of any problems that might be caused by a fluid influx into the wellbore 12 from the formation F or a loss of drilling mud into the formation F. In addition, the control system 200 can automatically detect, control, and circulate out such influxes and losses by operating the chokes 122 on the choke manifold 120 and performing other automated operations.

A change between the flow-in and the flow-out can involve various types of differences, relationships, decreases, increases, etc. between the flow-in and the flow-out. For example, flow-out may increase/decrease while flow-in is maintained; flow-in may increase/decrease while flow-out is maintained, or both flow-in and flow-out may increase/decrease.

In general, a possible fluid influx or "kick" can be noted when the "flow-out" value (measured from the flowmeter 124) deviates from the "flow-in" value (measured from the flowmeter 166*a-b* or the stroke counters of the mud pumps 150). As is known, a "kick" is the entry of formation fluid into the wellbore 16 during drilling operations. The kick occurs because the pressure exerted by the column of drilling fluid is not great enough to overcome the pressure exerted by the fluids in the formation being drilled.

On the other hand, a possible fluid loss can be noted when the "flow-in" value (measured from the stroke counters of the pumps 150 or inlet flowmeter 166*a-b*) is greater than the "flow-out" value (measured by the flowmeter 124). As is known, fluid loss is the loss of whole drilling fluid, slurry, or treatment fluid containing solid particles into the formation matrix. The resulting buildup of solid material or filter cake may be undesirable, as may be any penetration of filtrate through the formation, in addition to the sudden loss of hydrostatic pressure due to rapid loss of fluid.

Similar steps as those given above, but suited for fluid loss, can then be implemented by the control system 200 to manage the pressure and flow during drilling in this situation. In general, higher density mud loss control materials (LCM), and the like may be pumped into the wellbore 16, and other remedial measures can be taken. For example, the operator can initiate pumping new mud with the recommended or selected kill mud weight. As the kill mud starts to go down the wellbore 12, the chokes 122 are opened up gradually approaching a snap position as the kill mud circulates back up to the surface. Once the kill mud turns the bit 18, the control system 200 again switches back to the standpipe pressure (SPP) control until the kill mud circulates all the way back up to the surface.

During drilling operations, the control system 200 operates the return choke 122 so that a target bottom hole pressure (BHP) is maintained in the annulus during the drilling operation. The target BHP may be selected within a drilling window defined as greater than or equal to a minimum threshold pressure, such as pore pressure (PP), of the lower formation F and less than or equal to a maximum threshold pressure, such as fracture pressure (FP), of the lower formation, such as an average of the pore and fracture BHPs. Alternatively, the minimum threshold may be stability pressure and/or the maximum threshold may be leakoff pressure. Alternatively, threshold pressure gradients may be used instead of pressures and the gradients may be at other depths along the lower formation F besides bottomhole, such as the depth of the maximum pore gradient and the depth of the minimum fracture gradient. Alternatively, the control system 200 may be free to vary the BHP within the window during the drilling operation. A static density of the drilling fluid (typically assumed equal to returns; effect of cuttings typically assumed to be negligible) may correspond to a threshold pressure gradient of the lower formation F, such as being greater than or equal to a pore pressure gradient.

During the drilling operation, the control system 200 can execute a real-time simulation of the drilling operation to predict the actual BHP from measured data, such as from the standpipe pressure SPP measured from the sensor 250*a-c*, mud pump flowrate measured from the supply flowmeter 166*a*, wellhead pressure from any of the sensors, and return fluid flowrate measured from the return flowmeter 124. The control system 200 then compares the predicted BHP to the target BHP and adjust the return choke 122 accordingly.

During the drilling operation, the control system 200 also performs a mass balance to monitor for instability of the lower formation F, such as a kick even or lost circulation event. As the drilling fluid is being pumped into the wellbore 12 by the mud pump 150 and the returns are being received from the return line 32, the control system 200 may compare the mass flow rates (i.e., drilling fluid flow rate minus returns flow rate) using the respective flow meters 124, 166*a*. The control system 200 may use the mass balance to monitor for formation fluid (not shown) entering the annulus and contaminating the returns or returns entering the formation F.

Upon detection of instability (e.g., kick), the control system 200 takes remedial action, such as diverting the flow of returns from an outlet of the return flowmeter 124 to the mud gas separator 130. A gas detector of the separator 130 can use a probe having a membrane for sampling gas from the returns, a gas chromatograph, and a carrier system for delivering the gas sample to the chromatograph. The control system 200 may also adjust the returns choke 122 accordingly, such as tightening the choke in response to a kick and loosening the choke in response to loss of the returns.

Alternatively, the control system 200 may include other factors in the mass balance, such as displacement of the drillstring and/or cuttings removal. The control system 200 may calculate a rate of penetration (ROP) of the drill bit 18 by being in communication with the drawworks and/or from a pipe tally. A mass flowmeter may be added to the cuttings chute of the shaker 140. and the control system 200 may directly measure the cuttings mass rate.

Figure 2:
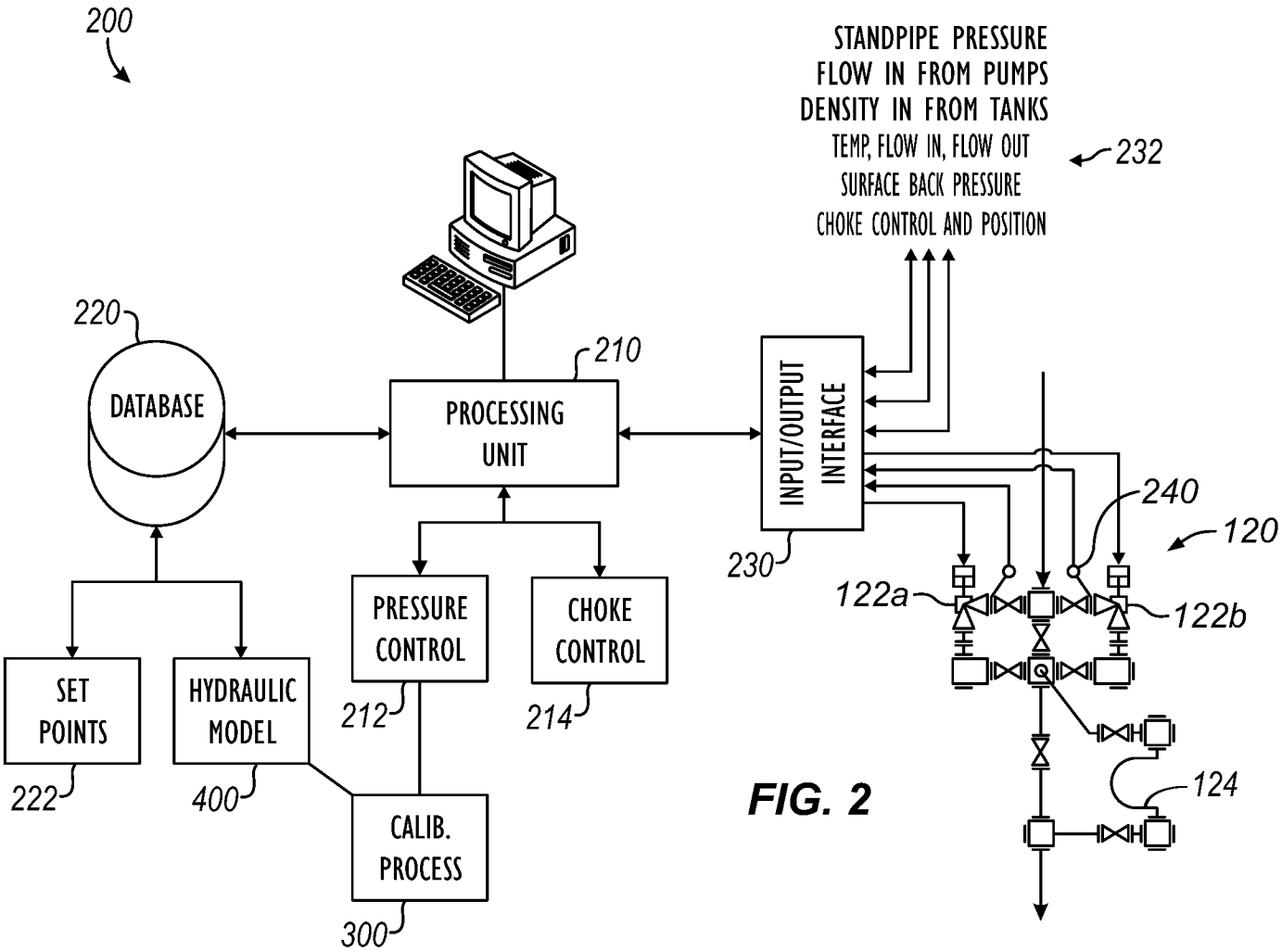
FIG. 2 schematically illustrates the control system of the present disclosure.

Having an understanding of the drilling system 10 and the control system 200, discussion now turns to some additional details of the components of the control system 200. FIG. 2 schematically illustrates some details of the control system 200 of the present disclosure. The control system 200 includes a processing unit 210, which can be part of a computer system, a server, a programmable control device, a programmable logic controller, etc. Using input/output interfaces 230, the processing unit 210 can communicate with choke manifold 120 and other system components to obtain and send communication, sensor, actuator, and control signals 232 for the various system components as the case may be. In terms of the current controls discussed, the signals 232 can include, but are not limited to, the choke position signals, pressure signals, flow signals, temperature signals, fluid density signals, etc.

In addition to the chokes 122*a-b*, the flowmeter 124, and pressure sensors 240, the choke manifold 120 can include a local controller (not shown) to control operation of the manifold 120, and can include a hydraulic power unit (HPU) and/or electric motor to actuate the chokes 122. The control system 200 is communicatively coupled to the manifold 120 and has a control panel with a user interface and processing capabilities to monitor and control the manifold 120.

The processing unit 210 also communicatively couples to a database or storage 220 having set points 222, a hydraulics model 400, and other stored information. The hydraulics model 400 characterizes the well pressure system. This information for the hydraulics model 400 can be stored in any suitable form, such as lookup tables, curves, functions, equations, data sets, etc. Additionally, multiple hydraulics models 400 or the like can be stored and can characterize the system in terms of different system arrangement, different drilling fluids, different operating conditions, and other scenarios.

As will be appreciated, the hydraulics model 400 of the control system 200 can be built based on the various components, elements, and the like in drilling system 10. The hydraulics model 400 can be built with any complexity desired to model the drilling system 10, which as noted above with reference to FIG. 1 can have a great deal of complexity and information associated with it and which can change over time depending on drilling parameters. The processing unit 210 operates a pressure control 212 according to the present disclosure, which uses a calibration process 300 for calibrating the hydraulics model 400 (i.e., refining the pressure loss characterization in the hydraulics model 400). (Details of how the pressure control 212 calibrates the hydraulics model 400 with the calibration process 300 will be discussed with reference to FIGS. 3-5.)

Finally, the processing unit 210 uses the current pressure profile from the pressure control 212 to operate a choke control 214 according to the present disclosure for monitoring and controlling the choke(s) 122*a-b*. For example, the processing unit 210 can transmits signals to one or more of the chokes 122*a-b* of the system 10 using any suitable communication. In general, the signals are indicative of a choke position or position adjustment to be applied to the chokes 122*a-b*. Typically, the chokes 122*a-b* are controlled by hydraulic power so that the signals 105 transmitted by the processing unit 210 may be electronic signals that operate solenoids, valves, or the like of an HPU for operating the chokes 122*a-b*.

As shown here in FIG. 2, two chokes 122*a-b* may be used. The same choke control 214 can apply adjustments to both chokes 122*a-b*, or separate choke controls 214 can be used for each choke 122*a-b*. In fact, the two chokes 122*a-b* may have differences that can be accounted for in the two choke controls 214 used.

As discussed herein, the control system 200 uses the choke control 214 tuned in real-time to manage surface backpressure SBP, and the control system 200 uses pressure measurements from sensors 240 associated with the choke(s) 122*a-b* to determine the surface backpressure SBP of the system.

Figure 3:
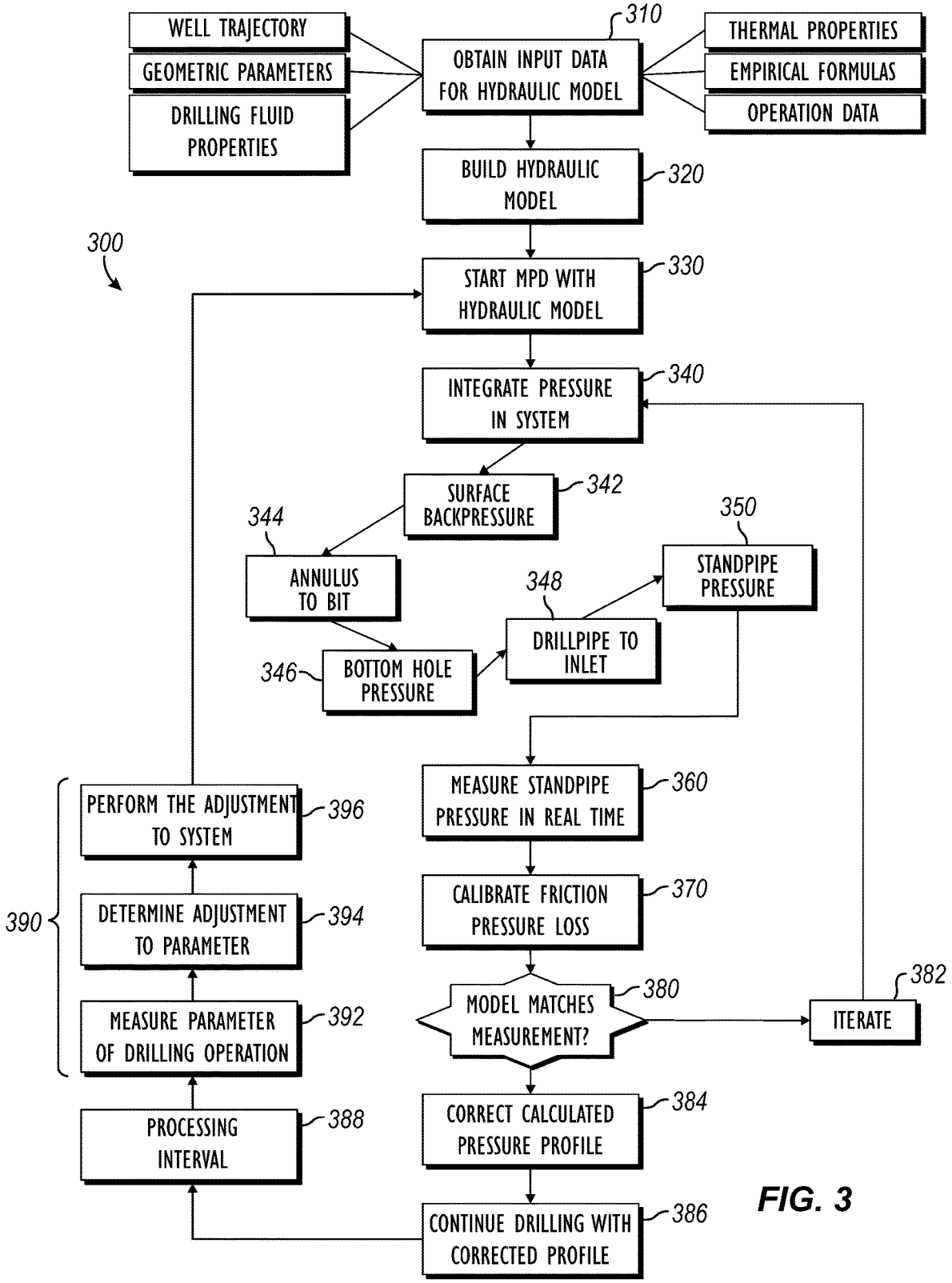
FIG. 3 illustrates a flow chart of a process for correcting a pressure profile of a hydraulic model used in drilling according to the present disclosure.

Having an understanding of the drilling system 10 and the control system 200, discussion now turns to a process 300 in FIG. 3 for correcting a pressure profile of a hydraulics model 400 used in drilling according to the present disclosure. For discussion, reference is made to the drilling system 10 and control system 200 of FIGS. 1-2.

The process 300 begins with obtaining data for input into the hydraulics model 400 of the drilling operation at hand (Block 310). Using the input data, the hydraulics model 400 is built as a well pressure model from the components, arrangement, properties, and other details of the drilling system 10 used during the MPD operation (Block 320).

As some examples, the hydraulics model 400 is built using input data of the well trajectory. The input data for the well trajectory include values for measured depth (MD), inclination, and azimuth. The hydraulics model 400 is also built using geometric parameters for the drilling system 10, including the geometry (diameter and depths) for the annulus (riser, casing, open hole) and the geometry for the drillstring segments.

The hydraulics model 400 is built using fluid properties of the drilling fluid used in the drilling operation. These fluid properties can include the drilling fluid's density (base type and fraction, PVT coefficients, composition fractions, salinity) and the fluid's rheology. The hydraulics model 400 is also built using thermal properties (specific heat, conductivity) for the fluid, formation, and metal elements of the system 10, and the hydraulics model 400 is built using the formation temperature. The hydraulics model 400 is further built using empirical formulas for the local pressure losses from particular tool(s) used for the drilling operations. These particular tools are typically customized tools for the drilling operation, such as the BHA 16, rotary steerable systems, the RCD 60, wellhead components, etc. Finally, the hydraulics model 400 is built using at least some of the operational data 232 obtained during drilling. The operational data 232 can include: surface backpressure (SBP), flow rate, rotation rate (RPM), bit depth, fluid input temperature, standpipe pressure (SPP), and the like.

The complexity of the hydraulics model 400 can be defined as desired, given all of the information available. Certain assumptions can be used in the hydraulics model 400. For example, the solution functions of the hydraulics model 400 can be assumed to depend on the measured depth (x) of the wellbore 12. Any radial dependence of the hydraulics model 400 may be assumed to be averaged. For convenience, the drillstring segments may be assumed to have a constant diameter. These and other assumptions can be used.

With the hydraulics model 400 built, the MPD operation can begin by using the constructed hydraulics model 400 to manage pressure, detect flow imbalance, determine influxes and losses, adjust the surface backpressure SBP with the chokes 122*a-b*, and perform other relevant operational steps as discussed previously (Block 330).

Figure 4:
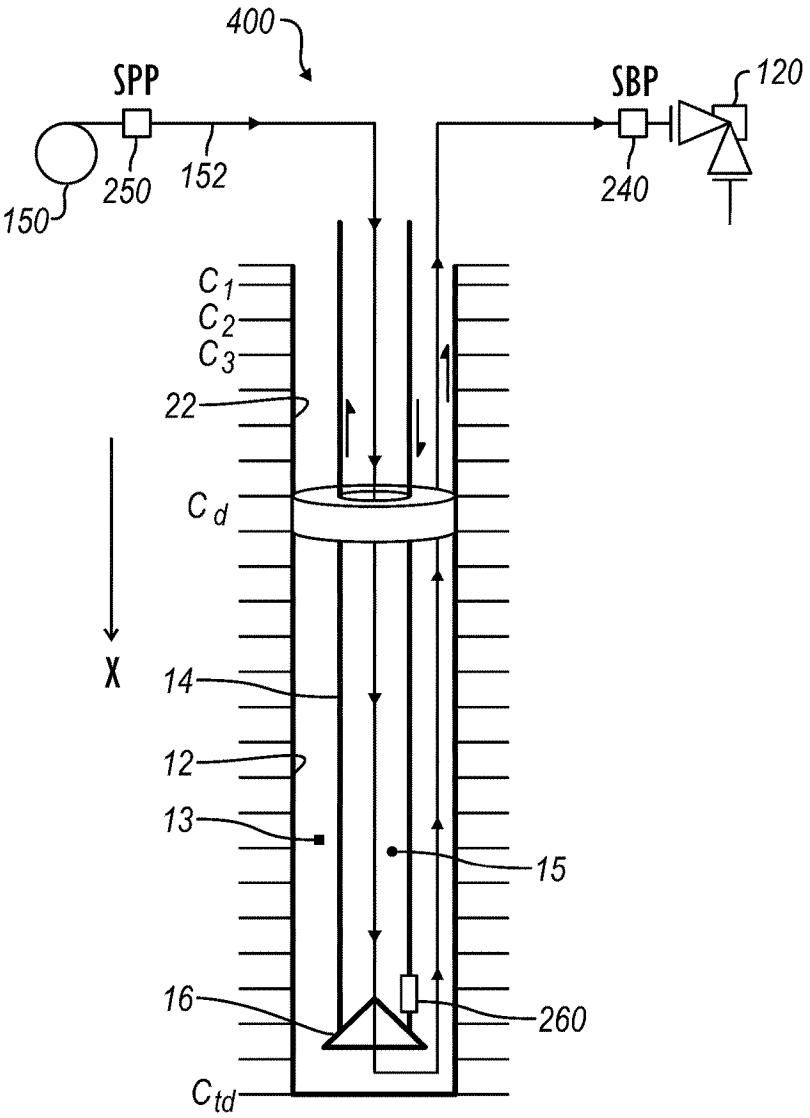
FIG. 4 illustrates a representation of a model of the drilling system for the present disclosure.

For reference, FIG. 4 illustrates a simplified representation of the hydraulics model 400 of the drilling system 10 for the present disclosure, corresponding the pressure integration blocks 340-350 in FIG. 3. Although not represented here, the model 400 would include iterations (increments) for the fluid PVT density, as well as iterations for the fluid temperature. The mud pump 150 at the inlet of the drilling system 10 pumps drilling fluid through the standpipe 152 into the drillstring 14, which is made up of known pipe details. The standpipe 152 includes the one or more pressure sensors 250 for measuring the standpipe pressure SPP.

The drilling fluid in the bore 15 of the drillstring 14 is subject to friction, hydrostatic pressures, different geometries of the drill pipes making up the drillstring 14, the characteristics of the drilling fluid, etc., which are defined in the hydraulics model 400. Exiting from the BHA 16, the drilling fluid then passes up the annulus 13 of the wellbore 12. The flow of the drilling fluid up the annulus 13 is subject to friction from the wellbore 12 and the drillstring 14, hydrostatic pressures, the geometry of the annulus 13, the characteristics of the drilling fluid, temperature of the formation, heat transfer variables, etc., which are defined in the hydraulics model 400. (As will be appreciated, when a riser 22 is used, the wellbore 12 for the hydraulics model would include both the borehole in the formation and the riser 22. Additionally, modeling of the wellhead may also be done as being part of the wellbore 12.)

The drilling fluid exits the annulus 13 at the outlet of the wellbore 12 and passes to the choke manifold 120. One or more pressure sensors 240 at the choke's inlet can measure the surface backpressure SBP. As an addition, the BHA 16 can include a pressure-while drilling (PWD) sensor 260 that can be used in determining a BHP of the drilling system 10. Further details of this are provided later.

To model all of the variables, the drilling system 10 is divided into a plurality of discrete cells C1, C2, . . . $C_d$ . . . to a cell $C_{td}$ at total depth (TD) at a given point in time in the drilling operation. A cell $C_d$ at a given depth is diagramed as a representation. The bore 15 inside the drillstring 14 can be modeled with its own cells, while the annulus 13 can be modeled with other cells.

The number of cells C can be suited to the given implementation, and the cells C can have similar or different intervals or increments (e.g., depths) along the wellbore 12 appropriate to the resolution of the different features of the drilling system 10. The cells C can change as drilling progresses, the wellbore 12 reaches further depth, new formations are drilled, new pipe stands are inserted into the drillstring 14, and new sections of the wellbore 12 are cased with liner. Modeling of the surface features, such as the standpipe 152, flow lines 32 from the riser package 30, etc., may also be done, although this is not shown in the representation of the drilling system 10 in FIG. 4.

Returning to FIG. 3, the hydraulics model 400 during the drilling operation is corrected in real-time using a calibration procedure (Blocks 340 to 382) in the pressure control 212 of the control system 200. This calibration procedure (Blocks 340 to 382) can be repeated at any time as necessary and desired during drilling.

The calibration procedure begins by integrating the well pressure profile in the closed-loop drilling system (Block 340). The pressure integration begins with the surface backpressure SBP produced in the well pressure profile by the choke manifold 120 (Block 342). (As noted, one or more sensors 240 upstream of the choke manifold 120 can provide readings of the surface backpressure SBP).

Pressure from this starting point is then integrated in the profile's modeled cells C along the annulus 13 between the drillstring 14 and the wellbore 12 (riser, casing, open hole) to the drill bit 18 (Block 344). The integration of the pressure produces an estimate of a current BHP for the drilling operation (Block 346). (If PWD data is available from a PWD sensor 260, the estimated bottom hole pressure $BHP_E$ can be compared to a bottom hole pressured $BHP_M$ determined from the PWD data, as discussed later.)

From the BHA 16, the pressure is then integrated in the profile's modeled cells C up the bore 15 of the drillstring 14 to the system's inlet (e.g., standpipe 152), where an estimated value for the standpipe pressure $SPP_E$ is the final calculated pressure of the integration (Block 350). Pressure loss at the bit 16 may also be considered.

Having integrated the pressure of the well pressure profile starting from the known surface backpressure $SBP_M$ reading to an estimated standpipe pressure $SPP_E$, the control system 200 further obtains a representative measurement of the standpipe pressure $SPP_M$ in real-time from the inlet pressure sensors 250*a-c* and compares the measured standpipe pressure $SPP_M$ to the estimated standpipe pressure $SPP_E$ to determine an error or difference (Block 370).

In turn, the control system 200 uses the determined error to calibrate pressure losses in the hydraulics model 400 so that the integration of the pressure profile in the hydraulics model 400 with calibrated pressure losses can produce a more accurate estimate of the standpipe pressure SPP. Ultimately, the hydraulics model 400 and the calibrated pressure losses that the hydraulics model 400 includes would improve the model to control the MPD operation by the control system 200 as the drilling system 10 continues drilling the wellbore 12.

The calibration may take several iterations of the integration in the profile's modeled cells C and may require several adjustments of the pressure loss factors, model parameters, and the like to achieve a calibration level within a defined accuracy. Overall, the entire process of the calibration may be governed by a processing interval (Block 388) of the control system's processing unit 210. Preferably, the processing unit 210 includes the hydraulics model 400 in firmware to improve the processing interval. For example, the processing unit 210 may operate to provide pressure loss calibration of the hydraulics model 400 every 500-ms, 1-s, or other interval.

Looking at these calibration steps more closely, it is clear that the measured surface backpressure $SBP_M$ (i.e., as measured by pressure sensors 240) can be known with a high degree of accuracy. Therefore, the control system 200 can assume zero error at the start of the integration process. The difference between the estimated standpipe pressure $SPP_E$ and the reference standpipe pressure $SPP_M$ measured by the pressure sensor 250*a-c* therefore represents how pressure losses are missing in the hydraulics model 400. The error increases in the integration from the surface backpressure $SBP_E$ through the annulus 13 and up drillstring bore 15 to the estimated standpipe pressure $SPP_E$ based on how frictional pressure loss and hydraulic pressure loss are modeled in the hydraulics model 400.

Once the error is determined, the control system 200 can then interpolate this error for any desired depth in the wellbore 12 and can correct the calculated pressure profile of the hydraulics model 400 based on this error. In the end, this calibration procedure provides details of the pressure losses (and more particularly the friction pressure loss in the annulus 13) in the drilling operation where a mud rheological reading may not be available or is not measured at the downhole condition.

Figure 5:
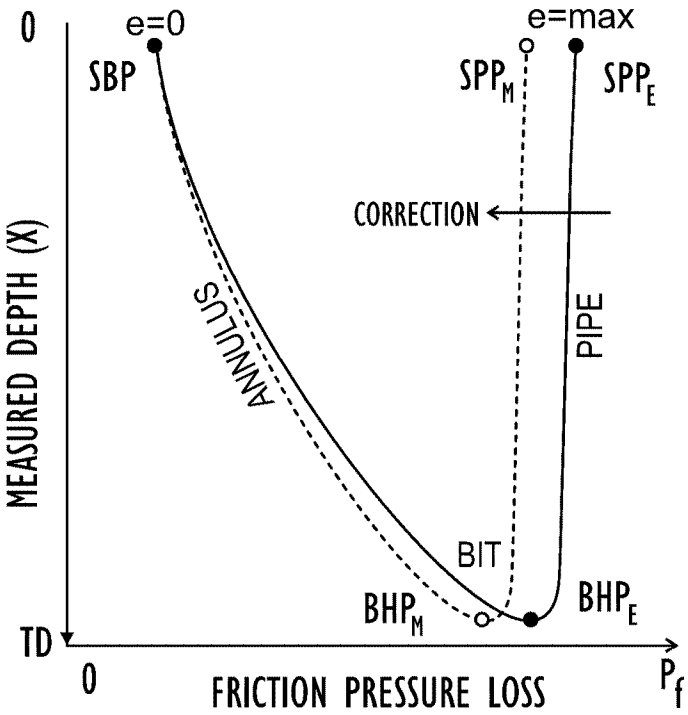
FIG. 5 graphs a representation of friction pressure loss in the hydraulics model of the system.

As a brief example, FIG. 5 graphs a representation of friction pressure loss in the hydraulics model (400) of the drilling system (10). Friction pressure loss is graphed as a function of depth in the system starting from surface, through the drillstring's bore (15) to the bit at a current total depth, and then up the annulus (13) back to surface. The total friction (and the resulting friction pressure loss it would produce) increases through the system (10) as the drilling fluid is pumped down the pipe, turns the bit, and then rises up the annulus (13) to surface.

In the calibration process, the measured surface backpressure $SBP_M$ from the flow out of the annulus (13) by the pressure sensor (240) upstream of the choke manifold (120) would represent a reading with little expected error (i.e., e=0). Yet, the integration of the calibration process integrating from the measured surface backpressure $SBP_M$, down the annulus (13), and up the drillstring's bore (12) to the standpipe (152) would produce an estimated standpipe pressure $SPP_E$ with the greatest error because the actual frictional pressure losses may not be adequately modeled in the system (10).

However, the error between the estimated standpipe pressure $SPP_E$and the measured standpipe pressure $SPP_M$ (as measured by the standpipe sensor 250*a-c*) provides an indication of friction factors missing in the system's modeling, which would in turn lead to frictional pressure losses not accurately reflected in the hydraulics model (400). A correction of the friction pressure loss is represented in FIG. 5. The goal of the calibration process is therefore to determine the friction pressure losses increment, so the hydraulics model can be corrected.

Hydrostatic pressure estimation can be similarly characterized in the manner described above. Overall, error in the hydraulics model due to hydrostatic pressure changes may have less impact or may be corrected in a more straightforward fashion. In fact, the hydrostatic pressure from the column of mud may already be considered in the overall BHP calculation. Either way, the present section describes the techniques for calibration the friction pressure losses because they may tend to have a greater impact and may be more dynamic in nature.

To calibrate the friction loss, the hydraulics model 400 uses factors in the hydraulics model's pressure loss formula, which follows an American Petroleum Institute's API-13D model for "Rheology and Hydraulics of Oil-well Drilling Fluids" and is based on Herschel-Bulkley rheology. The assumed model yields the following relation for the standpipe pressure SPP and the pressure losses:

$$SPP_E = SBP_M + dP_{u\text{-}tube} + dP_{friction}$$

Thus, the estimated standpipe pressure $SPP_E$ is calculated as the sum of the measured surface backpressure $SBP_M$, the U-tube pressure difference ($dP_{u\text{-}tube}$), and the friction pressure loss ($dP_{friction}$) of the system 10. The U-tube pressure difference $dP_{u\text{-}tube}$) is a difference in the hydrostatic pressures in the annulus ($dP_{h,a}$) and hydrostatic pressures in the drillstring ($dP_{h,ds}$) and can be characterized as:

$$dP_{u\text{-}tube} = dP_{h,a} - dP_{h,ds}$$

The frictional pressure loss ($dP_{friction}$) consists of the distributed friction ($P_f$) and local pressure losses ($dP_{local}$), such as in the bit, tool joints and custom tools, and can be characterized as:

$$dP_{friction} = P_f + dP_{local}$$

The distributed friction pressure loss is an integral along the flow path (in the drillstring and the annulus). It can be defined by the following known friction gradient (written in SI units as a function of the fluid density p, frictional factor f, fluid velocity V, fluid temperature T, hydraulic diameter Dh, and measured depth x):

$$\frac{\partial P_f}{\partial x} = -\frac{2\rho f(\rho, V, T)V|V|}{D_h}$$

As noted above, the integration of the pressure profile in the hydraulics model 400 from the measured surface backpressure $SBP_M$ produces an estimated standpipe pressure $SPP_E$ (Block 350). The calibration procedure then uses the measured standpipe pressure ($SPP_M$) as a reference (Block 360). As noted, this measured standpipe pressure $SPP_M$ can be measured in real-time using pressure sensors 250*a-c* off the outlet of the mud pumps 150 in the drilling system 10.

As already noted above, the expected error in the hydraulics model 400 due to hydrostatic pressure difference may have less impact or may be corrected in a more straightforward fashion. Accordingly, the process 300 of FIG. 3 does not directly address the hydrostatic pressure difference, but the difference could be similarly calibrated. For this reason, the process 300 focuses on the friction pressure losses because the calculation of the estimated standpipe pressure $SPP_E$ in the hydraulics model 400 mostly depends on the frictional pressure loss used in the hydraulics model 400. In other words, it can be assumed that the error in the estimated standpipe pressure $SPP_E$ is based primarily on the frictional factor (f) calculation. Therefore, the estimation of the standpipe pressure SPP may be understood to relate to the average frictional factor (f). In this way, the measured standpipe pressure $SPP_M$ provides an indication of the frictional factors for the calibration of the hydraulics model 400.

Accordingly, the process 300 of FIG. 3 proceeds with calibrating the friction pressure loss in the hydraulics model 400 (Block 370). The calibration may involve several iterations (Block 380, 382) until the hydraulics model's solution with its estimated standpipe pressure $SPP_E$ matches the measured standpipe pressure $SPP_M$ within some threshold (Yes at Decision 380). The comparative match would result in a calibrated friction pressure loss in the system 10 producing an estimated standpipe $SPP_E$ matching the measured standpipe pressure $SPP_M$ within a needed accuracy, which can be defined by a tolerance value of $\varepsilon_{SPP}$.

Given the calibrated factors of the friction pressure loss in the hydraulics model 400, the calibrated pressure profile from the hydraulics model 400 is corrected (384), and the drilling system 10 continues drilling with the corrected profile of the hydraulics model 400 (Block 386).

This iterative process starts with calculating an initial friction factor $f_0(x)$ of the hydraulics model 400. The initial friction factor $f_0(x)$ is based on input rheology data and API-13D model, as noted previously. The iterative process then repeats the following steps of pressure integration and calibration estimation for iteration index i=0, . . . $I_{end}$. First, the process integrates pressures, based on the friction factor $f_i(x)$, to calculate frictional pressure loss $dP_{f,i}$, and estimated standpipe pressure ($SPP_i$). A calibration coefficient is then estimated as:

$$A_{f,i} = \frac{dP_{f,i}}{\text{averaged}(f_i)}$$

The calibrated frictional factor for the hydraulics model is incremented in the iterations. The calibrated frictional factor is proportional to the difference $dSPP_i$, and is given by:

$$f_{i+1}(x) - f_i(x) = df_i = \frac{dSPP_i}{A_{f,i}}$$

Here, the frictional factor increment may be a constant. In other implementations, the calibration can include the frictional factor increment as a function of measured depth (x). The iterations are continued until the difference between calculated $SPP_i$ and the reference $SPP_M$ measured by the pressure sensor 250 produces an error within a given threshold. The difference at the end of an iteration is given by:

$$dSPP_i = SPP_i - SPP_M.$$

If $dSPP_i$ is within the defined threshold or margin $\varepsilon_{SPP}$, further iteration steps are not needed. Otherwise, additional iterations are needed until with error is within the threshold εSPP, which may vary and can be set according to a given implementation.

In the end, the corrected hydraulics model 400 has the pressure profile based on the final frictional factor, which has been incremented by the iterations. The corrected model 400 is used in the pressure control 212 of the MPD operation (Block 390) in order to manage pressure. In the end, being able to manage pressure allows drill operations more effectively to reach target depths, stay within the drilling window, handle imbalance, and perform other operations noted herein. For example, the frictional factor can be used for an accurate estimation of the BHP in the drilling operation. The estimated BHP can be given by:

$$BHP = SBP + dP_{h,a} + dP_{friction,a}$$

In the managed pressure drilling operation (Blocks 390), the control system 200 measures a parameter of the drilling operation (Block 392), determines an adjust to the parameter (394), and performs the adjustment (396). For example, the surface backpressure SBP may need to be adjusted because there is an imbalance between the flow-in versus the flow-out indicative of a kick or influx. Therefore, a new choke position is determined to produce the needed surface backpressure SBP to control the kick, and the system 200 actuates the chokes 122*a-b* to produce the surface backpressure SBP. Comparable adjustments can be made for other well control operations with the system 200.

When the calibration procedure (Blocks 340 to 382) is used while the drillstring 14 is not being rotated (RPM=0), then the frictional factor increment provides an improved understanding of the rheology characteristics of the fluid. Then, the measured SPP data with RPM>0 can be used for a correction of rotational friction in the annulus. The frictional power loss in the annulus is assumed to be a sum of the unrotational friction and a rotational increment:

$$P_{f,a}=P_{f,0}+dP_{rot}$$

As a simple model, the rotational pressure loss increment can then be assumed to proportional to the rotation rate.

In contrast to existing techniques, the measured SPP data is used to calibrate a calculated pressure profile of the hydraulics model 400 used during the drilling operation. Advantageously, data from the sensors (240, 250*a-c*) can be readily available in real-time at high speed. In the meantime, PWD data may not always be available and is often delayed data. For example, PWD data may only be available at flow rates above 250-gpm so there may not even be data available for calibration during drillpipe connections or during low SCR. Aside from that, the PWD data cannot be run during a cement job. For these reasons, the SPP data used in the disclosed calibration process 300 provides a useful source for knowing what is going on downhole.

Nevertheless, the teachings of the present disclosure can further benefit by using PWD data, as hinted to above. As noted above with respect to FIG. 4, a measured value of pressure-while-drilling (PWD) can be obtained with a PWD sensor 260 on the BHA 16 of the drillstring 14. The integration of the pressure profile of the hydraulics model 400 for the system 10 can then determine two errors for calibrating the pressure losses in the hydraulics model 400.

For instance, returning to FIG. 5, the integration starts from the surface backpressure SBP measured at the choke's sensor (240) and integrates down the annulus (13). This integration leg can be used to estimate a value of a bottom hole pressure ($BHP_E$). A measured value of the bottom hole pressure $BHP_M$ as determined from PWD data measured with the PWD sensor 260 on the BHA 16 can then be compared to the estimated bottom hole pressure $BHP_E$. This first different between estimated bottom hole pressure $BHP_E$ and measured bottom hole pressure $BHP_M$ can provide an intermediate error indicative of the pressure losses missing from the hydraulics model 400 in this annular leg.

Meanwhile, the integration from the BHA (16) up the drillstring (14) can be used to estimate a value of standpipe pressure $SPP_E$. As before, the estimated standpipe pressure value $SPP_E$ can be compared to the measured value of the standpipe pressure $SPP_M$ from standpipe sensor 250*a-c* after the pumps 150. This second difference between estimated standpipe pressure $SPP_E$ and measured standpipe pressure $SPP_M$ can provide another error indicative of the pressure losses missing from the hydraulics model 400 in this drillstring leg. These two differences can be used for the correction of the friction pressure loss is represented in FIG. 5. Accordingly, the calibration steps (Blocks 340-384) described above can be readily modified to calibrate pressure loss based on these two differences.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

As will be appreciated, teachings of the present disclosure can be implemented in digital electronic circuitry, computer hardware, computer firmware, computer software, programmable logic controller, or any combination thereof. Teachings of the present disclosure can be implemented in a programmable storage device (computer program product tangibly embodied in a machine-readable storage device) for execution by a programmable control device or processor (e.g., control system 200, processing unit 210, etc.) so that the programmable processor executing program instructions can perform functions of the present disclosure. The teachings of the present disclosure can be implemented advantageously in one or more computer programs that are executable on a programmable system (e.g., control system 200, processing unit 210, etc.) including at least one programmable processor coupled to receive data and instructions from, and to transmit data and instructions to, a data storage system (e.g., database 220), at least one input device, and at least one output device. Storage devices suitable for tangibly embodying computer program instructions and data include all forms of non-volatile memory, including by way of example semiconductor memory devices, such as solid-state devices, EPROM, EEPROM, and flash memory devices; magnetic disks such as internal hard disks and removable disks; magneto-optical disks; and CD-ROM disks. Any of the foregoing can be supplemented by, or incorporated in, ASICs (application-specific integrated circuits).

The following table of abbreviations are used herein:

| Abbreviation | Definition |
|---|---|
| AP | Annular Pressure |
| BHA | Bottom Hole Assembly |
| BHP | Bottom Hole Pressure |
| BOP | Blow out preventer |
| CBHP | Constant BHP |
| F | Formation |
| FP | Fracture Pressure |
| HPU | Hydraulic Power Unit |
| LCM | Lost Circulation Material |
| MPD | Managed Pressure Drilling |
| PP | Pore Pressure |
| PWD | Pressure-while-Drilling |
| RCD | Rotating Control Device |
| ROP | Rate of Penetration |
| RPM | Rotations per Minute |
| SBP | surface back-pressure |
| SPP | Stand-Pipe pressure |
| TD | Total Depth |
| UBD | Underbalanced Drilling |
| UMRP | Upper Marine Riser Package |

The following subscripts are used herein:

| Subscript | Description |
|---|---|
| E | Estimated |
| f | friction |

-continued

| Subscript | Description |
|---|---|
| i | iteration index |
| M | Measured |

The following reference numerals are used for elements throughout the disclosure:

| Numeral | Element |
|---|---|
| 10 | drilling system |
| 12 | borehole/wellbore |
| 13 | annulus |
| 14 | drillstring |
| 15 | drillstring bore |
| 16 | bottom-hole assembly (BHA) |
| 18 | drill bit |
| 20 | wellhead |
| 22 | riser |
| 24 | auxiliary line |
| 30 | riser package (UMRP) |
| 32 | flow line |
| 40 | flow spool |
| 42 | flow connections |
| 50 | annular seal device |
| 60 | rotating control device (RCD) |
| 70 | diverter |
| 72 | flex joint |
| 74 | slip joint |
| 76 | tensioner |
| 78 | tensioner ring |
| 100 | mobile offshore drilling unit |
| 110 | drilling rig |
| 112 | derrick |
| 114 | top drive inlet |
| 116 | top drive |
| 118 | flow sub |
| 120 | choke manifold |
| 122 | choke |
| 124 | outlet flowmeter |
| 126 | Gas evaluation device |
| 128 | multi-phase flowmeter |
| 130 | separator |
| 140 | shaker |
| 142 | mud tank |
| 144 | transfer line |
| 150 | mud pump |
| 152 | standpipe |
| 160 | flow equipment |
| 162a-b | pressure chokes |
| 165a-b | bypass line |
| 166a-b | inlet flowmeter |
| 170 | hydraulic power unit (HPU) |
| 172 | manifold |
| 164a-b | bypass/supply flowmeter |
| 174 | clamp |
| 200 | control system |
| 202 | control lines |
| 210 | processing unit |
| 212 | pressure control |
| 214 | choke control |
| 220 | database |
| 222 | set point |
| 230 | input/output interface |
| 232 | operational data |
| 240 | outlet (choke) pressure sensor |
| 250 | inlet (standpipe) pressure sensor |
| 260 | PWD sensor for BHP |
| 300 | calibration process |
| 310 | data input for the model |
| 320 | model build |
| 330 | MPD start |
| 340 | pressure integration |
| 342 | surface backpressure (SBP) |
| 344 | annulus pressure integration |
| 346 | bottomhole pressure (BHP) |
| 348 | drillpipe pressure integration |

-continued

| Numeral | Element |
|---|---|
| 350 | standpipe pressure (SPP) estimated |
| 360 | SPP measured |
| 370 | frictional pressure calibrated |
| 380 | SPP error analyzed |
| 382 | calibration iteration |
| 384 | calculated pressure corrected |
| 386 | drilling continued |
| 388 | processing interval |
| 390 | MPD operation |
| 392 | drilling operation parameter measured |
| 394 | parameter adjustment |
| 396 | system adjustment |
| 400 | hydraulic model |

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method, implemented by a computerized control, for a drilling system, the drilling system having a drillstring with a bottom hole assembly for drilling a wellbore, having at least one pump for pumping drilling fluid at an inlet into the drillstring in the wellbore, and having at least one choke for choking the drilling fluid at an outlet from the wellbore, the method comprising:

drilling the wellbore with the drilling system;

building a hydraulics model of the drilling system drilling the wellbore;

obtaining a measured value of surface backpressure of the outlet;

obtaining a measured value of standpipe pressure of the inlet;

determining an estimated value of standpipe pressure of the inlet based on the hydraulics model and the measured surface backpressure value by integrating a pressure profile of the hydraulics model in a plurality of increments from the measured surface backpressure value of the outlet, down an annulus of the wellbore to the bottom hole assembly, up the drillstring, and to the inlet;

correcting pressure loss in the hydraulics model based on a difference between the measured standpipe pressure value and the estimated standpipe pressure value by iteratively incrementing friction factor values at the plurality of increments in the pressure profile at least until the estimated standpipe pressure value matches the measured standpipe pressure value within a threshold;

obtaining a measured value of a parameter in the drilling system; and adjusting the parameter in the drilling system at least partially based on the hydraulics model corrected for the pressure loss.

2. The method of claim 1, wherein building the hydraulics model of the drilling system drilling the wellbore comprises building the hydraulics model using one or more of: a trajectory of the wellbore, a measured depth of the wellbore, an inclination of the wellbore, an azimuth of the wellbore, a geometric parameter of the drilling system, a geometry of an annulus of the wellbore, a geometry of a drillstring, a fluid property of the drilling fluid, a density of the drilling fluid, a rheology of the drilling fluid, a thermal property for the drilling fluid, a thermal property of the formation, a thermal property of the drillstring, a temperature of a formation in the wellbore, an empirical formula for local pressure loss from a component of the drilling system, operational data obtained during drilling, flow rate, rotation rate (RPM), bit depth, and fluid input temperature.

3. The method of claim 1, wherein obtaining the measured surface backpressure value of the outlet comprises measuring the value of the surface backpressure with a sensor disposed upstream of the at least one choke.

4. The method of claim 3, wherein the sensor is selected from the group consisting of a pressure transducer, a pressure gauge, a diaphragm based pressure transducer, and a strain gauge based pressure transducer, an analog device, and an electronic device.

5. The method of claim 1, wherein obtaining the measured value of the standpipe pressure of the inlet comprises measuring the value of the standpipe pressure with a sensor disposed in communication with flow of the drilling fluid into the drillstring downstream of the at least one pump.

6. The method of claim 5, wherein the sensor is selected from the group consisting of a pressure transducer, a pressure gauge, a diaphragm based pressure transducer, and a strain gauge based pressure transducer, an analog device, and an electronic device.

7. The method of claim 1, wherein integrating the pressure profile of the hydraulics model in the plurality of increments from the measured surface backpressure value of the outlet to the inlet comprises:

determining an estimated bottom hole pressure by integrating the pressure profile from the measured surface backpressure value down the annulus of the wellbore to the bottom hole assembly of the drillstring; and determining the estimated standpipe pressure value by integrating the pressure profile from the estimated bottom hole pressure up the drillstring to the inlet from the at least one pump.

8. The method of claim 1, wherein determining the estimated value of the standpipe pressure of the inlet comprises calculating the estimated standpipe pressure value as a sum of the measured surface backpressure value, a U-tube pressure loss, and a friction pressure loss.

9. The method of claim 8, wherein the U-tube pressure loss comprises a difference in first hydrostatic pressure in the annulus of the wellbore and second hydrostatic pressure in the drillstring of the drilling system.

10. The method of claim 8, wherein the friction pressure loss comprises a value of distributed friction and a value of any local pressure loss from one or more components of the drilling system.

11. The method of claim 1, further comprising determining another factor of the pressure loss due to rotational friction in the annulus of the wellbore by refining rheology characteristics of the drilling fluid when the drillstring is not being rotated.

12. The method of claim 1, further comprising:

obtaining a measured value of pressure-while-drilling indicative of bottom hole pressure at the bottom hole assembly of the drillstring;

determining an estimated value of bottom hole pressure at the bottom hole assembly based on the hydraulics model and the measured bottom hole pressure value; and correcting the pressure loss in the hydraulics model based on another difference between the measured bottom hole pressure value and the estimated bottom hole pressure value.

13. The method of claim 1, wherein adjusting the parameter in the drilling system comprises adjusting the at least one choke in communication with the drilling fluid from the wellbore.

14. The method of claim 1, wherein adjusting the parameter comprises adjusting a flow rate or a pressure of flow of the drilling fluid out of the wellbore using the at least one choke.

15. The method of claim 1, wherein adjusting the parameter in the drilling system comprises adjusting at least one of: a flow rate of the drilling fluid out of the wellbore using the at least one choke, a pressure of flow of the drilling fluid out of the wellbore using the at least one choke, a current surface backpressure in the wellbore, a mass flow rate of the drilling fluid out of the wellbore, a pressure during make-up of a drillpipe connection while drilling with the drilling system, a pressure during a loss detected while drilling with the drilling system, or flow during a kick detected while drilling with the drilling system.

16. The method of claim 1, where obtaining the measured value of the parameter in the drilling system comprises:

determining outflow of the drilling fluid from the wellbore;

determining inflow of the drilling fluid into the wellbore; and determining an imbalance between the outflow and the inflow as the measured parameter value.

17. The method of claim 16, wherein determining the outflow of the drilling fluid from the wellbore comprises measuring the outflow with a flowmeter in communication with the outflow; and wherein determining the inflow of the drilling fluid into the wellbore comprises measuring the inflow with a flowmeter in communication with the inflow.

18. A programmable storage device having program instructions stored thereon for causing a programmable control device to perform a method of drilling a wellbore with drilling fluid using a drilling system according to claim 1.

19. A system for drilling a wellbore with drilling fluid, the system comprising:

at least one pump disposed at an inlet of the system and operable to pump the drilling fluid into the wellbore when drilling the wellbore with the drilling system;

at least one choke disposed at an outlet of the system and operable to adjust flow of the drilling fluid from the wellbore when drilling the wellbore with the drilling system;

storage storing a hydraulics model of the drilling system drilling the wellbore;

a first sensor configured to measure a value of surface backpressure upstream of the at least one choke;

a second sensor configured to measure a value of standpipe pressure downstream of the at least one pump; and a programmable control device communicatively coupled to the storage, the first sensor, and the second sensor, the programmable control device configured to:

obtain a measured value of surface backpressure from the first sensor;

obtain a measured value of standpipe pressure from the second sensor;

integrate a pressure profile of the hydraulics model in a plurality of increments from the measured surface backpressure value of the outlet, down an annulus of the wellbore to a bottom hole assembly of a drillstring, up the drillstring, and to the inlet to determine an estimated value of standpipe pressure of the inlet based on the hydraulics model and the measured surface backpressure value;

iteratively increment friction factor values at the plurality of increments in the pressure profile at least until the estimated standpipe pressure value matches the measured standpipe pressure value within a threshold to correct pressure loss in the hydraulics model based on a difference between the measured standpipe pressure value and the estimated standpipe pressure value;

obtain a measured value of a parameter in the drilling system; and adjust the parameter in the drilling system at least partially based on the hydraulics model corrected for the pressure loss.

20. The system of claim 19, wherein to integrate the pressure profile of the hydraulics model in the plurality of increments from the measured surface backpressure value of the outlet to the inlet, the programmable control device is configured to:

integrate the pressure profile from the measured surface backpressure value down the annulus of the wellbore to the bottom hole assembly of the drillstring to determine an estimated bottom hole pressure; and integrate the pressure profile from the estimated bottom hole pressure up the drillstring to the inlet from the at least one pump to determine the estimated standpipe pressure value.

21. The system of claim 19, wherein to determine the estimated value of the standpipe pressure of the inlet, the programmable control device is configured to calculate the estimated standpipe pressure value as a sum of the measured surface backpressure value, a U-tube pressure loss, and a friction pressure loss; wherein the U-tube pressure loss comprises a difference in first hydrostatic pressure in the annulus of the wellbore and second hydrostatic pressure in the drillstring of the drilling system; and wherein the friction pressure loss comprises a value of distributed friction and a value of any local pressure loss from one or more components of the drilling system.

22. The system of claim 19, wherein the programmable control device is further configured to:

obtain a measured value of pressure-while-drilling indicative of bottom hole pressure at the bottom hole assembly of the drillstring;

determine an estimated value of bottom hole pressure at the bottom hole assembly based on the hydraulics model and the measured bottom hole pressure value; and correct the pressure loss in the hydraulics model based on another difference between the measured bottom hole pressure value and the estimated bottom hole pressure value.

* * * * *